United States Patent [19]

Lees et al.

[11] 4,442,249

[45] Apr. 10, 1984

[54] PARTIALLY ORIENTED POLYESTER YARN FINISH

[75] Inventors: Gerard D. Lees; Barry D. Causby, both of Charlotte, N.C.

[73] Assignee: Fiber Industries, Inc., Charlotte, N.C.

[21] Appl. No.: 449,068

[22] Filed: Dec. 13, 1982

Related U.S. Application Data

[63] Continuation-in-part of Ser. No. 433,330, Oct. 7, 1982, abandoned.

[51] Int. Cl.[3] ..... B01F 17/42; D06M 13/18; D06M 13/20

[52] U.S. Cl. ..... 523/455; 8/115.6; 252/8.9; 428/395

[58] Field of Search ..... 252/8.9; 428/395; 523/455; 8/115.6

[56] References Cited

U.S. PATENT DOCUMENTS

| | | | |
|---|---|---|---|
| 3,170,876 | 2/1965 | Olney | 252/8.8 |
| 3,336,222 | 8/1967 | Desmond, Jr. et al. | 252/8.7 |
| 3,462,291 | 8/1969 | Conner | 264/103 |
| 3,470,095 | 9/1969 | Pontelandoifo | 252/8.9 |
| 3,503,880 | 3/1970 | McMicken | 252/8.75 |
| 3,505,220 | 4/1970 | Connor et al. | 252/8.6 |
| 3,518,184 | 6/1970 | Potter et al. | 252/8.75 |
| 3,681,244 | 8/1972 | Dardoufas et al. | 252/8.8 |
| 3,756,972 | 9/1973 | Kobayashi et al. | 252/8.9 |
| 3,899,614 | 8/1975 | Kai et al. | 427/175 |
| 3,925,588 | 12/1975 | Dardoufas et al. | 428/395 |
| 4,118,326 | 10/1978 | Login | 252/8.6 |
| 4,134,882 | 1/1979 | Frankfort et al. | 528/308.2 |
| 4,137,181 | 1/1979 | Hawkins | 252/8.9 |
| 4,169,062 | 9/1979 | Weipert | 252/8.9 |
| 4,179,543 | 12/1979 | Hawkins | 428/361 |
| 4,294,883 | 10/1981 | Hawkins | 428/361 |
| 4,297,407 | 10/1981 | Manca | 428/224 |
| 4,340,382 | 7/1982 | Morlino et al. | 252/8.9 |
| 4,343,616 | 8/1982 | Decker et al. | 252/8.9 |
| 4,351,738 | 9/1982 | Takahashi et al. | 252/8.9 |

FOREIGN PATENT DOCUMENTS

| | | | |
|---|---|---|---|
| 53-31897 | 3/1978 | Japan | 252/8.9 |
| 53-31898 | 3/1978 | Japan | 252/8.9 |
| 56-140179 | 11/1981 | Japan | 252/8.9 |
| 56-140180 | 11/1981 | Japan | 252/8.9 |

*Primary Examiner*—Ronald W. Griffin
*Attorney, Agent, or Firm*—S. M. Bodenheimer, Jr.

[57] ABSTRACT

The invention provides an improved partially oriented polyester yarn finish which consists essentially of from about 50 to about 90 weight percent of one or more high molecular weight ethylene oxide/propylene oxide copolymers having an ethylene oxide content such that the ethylene oxide in the copolymer constitutes less than about 25 weight percent of the finish; from about 10 to about 35 weight percent of one or more alkyl chain based lubricants, a major amount of which has a smoke point within the range of from about 155° C. to about 200° C.; and an emulsifying amount of base neutralized fatty acid such as potassium oleate.

21 Claims, No Drawings

PARTIALLY ORIENTED POLYESTER YARN FINISH

This is a continuation-in-part of U.S. Patent application Ser. No. 433,330, filed Oct. 7, 1982, now abandoned.

BACKGROUND OF THE INVENTION

The invention relates to a finish for partially oriented polyester yarn. More specifically, the invention relates to a finish which enables texturing of partially oriented polyester yarn with a minimum of fouling of texturing apparatus.

False twist texturing of partially oriented polyester yarns involves heating the yarn by means of a heater tube or plate, and subsequently twisting the yarn by means of a friction disc, belt or spindle. Lubricating finishes are typically applied to the yarn prior to the texturing operation in order to prevent filament breakage and other damage to the yarn during texturing.

Finish composition has been shown to be the cause of numerous problems encountered in texturing operations and is believed to be the cause of other problems. For example, excessive wear of polyurethane texturing discs and/or polyacrylonitrile/polybutadiene texturing belts can be attributed to impregnation of the finish into the disc or belt surface resulting in the softening and subsequent degradation of the surface. Excessive fuming or volatilazation of the finish during texturing results in liquid condensation and dripping onto various parts of the texturing apparatus, resulting in a poorly textured product and/or nonuniformity of dyeing in the subsequent dyeing operation. Dye uniformity is likewise adversely affected when any of various finish components migrate into the yarn during the heating operation. Non-volatile components of finishes have been found to deposit on the heater plate or tube resulting in a tar or coke buildup which can damage both yarn and heating elements. Still another problem is "snow" or particulate emission during texturing. Finish may be responsible for the amount of snow and/or for the quality of snow, i.e., dry vs. tacky.

Avoidance of the aforesaid problems can be particularly difficult since the precise causes of broken filaments, heater deposition, fuming, dye uptake variability and tacky snow are not precisely understood. Further, modifying a finish to avoid one problem frequently aggravates another problem. For example, a decrease in the amount of fuming can be accompanied by an increase in heater deposition and vice versa.

Each of the above problems typically result in the necessity for shutting down an active texturing operation in order to clean and/or repair the texturing apparatus. As such downtime represents an expense for the texturer, finishes are sought which can be used for several months without fouling or harming equipment.

Thus, to be commercially acceptable, a partially oriented yarn finish must lubricate and cling to the yarn while it is being twisted at extremely high speeds while not damaging equipment or yarn. The provision of a finish for a partially oriented polyester yarn thus presents a multifaceted undertaking.

It is an object of this invention to provide a finish for partially oriented polyester yarn which minimizes filament breakage during texturing.

Another object of the invention is to provide a finish for partially oriented polyester yarn wherein both fuming and heater plate deposition are minimized.

Still another object of the invention is to provide a partially oriented polyester yarn finish which obviates dye uptake variability in the polyester yarn.

A further object of the invention is to provide a partially oriented polyester yarn finish which effects little or no decomposition of texturing discs, belts or other friction texturing devices.

A still further object of the invention is the provision of a polyester yarn finish which can be used in a texturing operation for several months without shut down of texturing apparatus.

SUMMARY OF THE INVENTION

The foregoing and other objects are achieved by the partially ented polyester yarn finish of the invention. The finish is an emulsifiable mixture consisting essentially of:

(a) from about 50 to about 90 weight percent of one or more ethylene oxide/propylene oxide copolymers having a molecular weight in excess of about 1000 and having an ethylene oxide content such that the ethylene oxide in the copolymer constitutes less than about 25 weight percent of the finish;

(b) from about 10 to about 35 weight percent of one or more alkyl chain based lubricants, a major amount of which has a smoke point within the range of from about 155° C. to about 200° C.; and (c) a base neutralized fatty acid, such as potassium oleate, in an amount in the range of from about 3 to about 10 weight percent, and sufficient to emulsify the ethylene oxide/propylene oxide copolymer and the alkyl chain based lubricant.

In advantageous embodiments of the invention, a small amount of one or more antioxidants can be included in the composition to minimize heater plate deposition. The alkyl based lubricant preferably comprises one or more alkyl ester oils. Advantageously, the smoke point of the alkyl based lubricant is such that 90% has a smoke point of from about 170° C. to about 180° C.

The finish of the invention minimizes or eliminates heater plate deposition, fuming, yarn dye uptake variability and attack on friction elements.

DETAILED DESCRIPTION OF THE INVENTION

The major component of the finish of the invention consists of one or more high molecular weight ethylene oxide/propylene oxide copolymers. Such copolymers will be present in an amount of from about 50–90 weight percent, advantageously 60–80 weight percent of the finish. Such materials will have a molecular weight of greater than 1000 and will preferably have a molecular weight of greater than about 1500. Such materials are commercially available in the form of both liquids and pastes, depending primarily on molecular weight. Typically, most if not all of the ethylene oxide/propylene oxide copolymer used in the finish of the invention will be liquid. However, the use of such copolymers in the form of pastes will be advantageous in some instances, for example, as where a higher finish viscosity is desired or where the particular ethylene oxide/propylene oxide copolymer paste can impart particular desirable properties to the finish.

The ethylene oxide content of the copolymer or copolymers used must be controlled so that the total ethylene oxide in the copolymer or copolymers will constitute less than 25 weight percent of the finish. It is believed that ethylene oxide content can be responsible for or contribute to problems during texturing including, decomposition of texturing discs or belts and/or increasing the tackiness or wetness of the snow, i.e., the particulate emmision seen during high speed texturing. Thus, ethylene oxide content is best kept to a minimum.

On the other hand, insufficient ethylene oxide content can interfere with the ability of the finish to form an emulsion with water. As discussed hereinafter, the finish will be applied to the yarn in emulsion form. Thus, it is important that there be sufficient ethylene oxide content to enable formation of an aqueous emulsion. Such minimum ethylene oxide content will be dependent on the nature of the various other components contained in the finish. For example, in some instances, an ethylene oxide content of nearly 25 weight percent may be necessary. In other instances, an ethylene oxide content as low as about 5 weight percent of the finish will suffice.

The nature of the alkyl chain based lubricant used in the finish of the invention is especially important. While such lubricant may be composed of one or more alkyl based oils, the major proportion, i.e., greater than 50 weight percent of the lubricant, must have a smoke point within the range of 155° C. to about 200° C. It is preferred that at least 90 weight percent of the lubricant has a smoke point within the aforesaid range. In an even more preferred embodiment, a major proportion of the lubricant will have a smoke point within the range of about 170° to about 180° C. Depending on the particular yarn and method of application of the finish, still better results can be obtained when in excess of 90 weight percent, or even more preferably in excess of 95 weight percent, of the lubricant has a smoke point within the range of 170° to 180° C.

Inclusion of a proportion of the lubricant having a smoke point outside of the ranges set forth above may be desirable to accomplish various objectives. For example, the use of 5 to 10 weight percent of a lower smoke point alkyl based lubricant can decrease the viscosity of the finish. Such a decrease in viscosity can be desirable when the finish is to be applied to a low denier, i.e., 70–150 denier partially oriented yarn. It will be recognized that use of such a lower smoke point lubricant may increase fuming of the finish, although such fuming increase will typically be within an acceptable range so long as the major part of the lubricant has a smoke point within the range set forth above. On the other hand, use of a proportion of lubricant having a smoke point above the preferred ranges set forth above may tend to increase deposits on the heater plate. Deposit increase will be minimal, however, so long as a major portion of the lubricant has a smoke point within the range set forth previously. In this regard, use of lubricants having a smoke point in the 155° C. to 200° C., preferably 170° C. to 180° C. range, promotes self cleaning of heater plates.

Alkyl chain based lubricants are well known to those skilled in the art and will typically be alkyl esters or di- or poly- alkyl esters of alcohols or ethers. Thus, lubricating dialkyl esters or mixed esters of tri- to hexaethylene glycol wherein the acid moieties having an average of from 7 to 12 carbon atoms are conveniently utilized in the invention so long as the particular ester meets the smoke point requirement set forth previously. Similarly, glycerol or sorbitol esters of 8 to 20 carbon fatty acids can be conveniently used when smoke point requirements are met. Likewise, di- or triesters comprising a condensate of an organic dibasic acid with at least one alcohol or a condensate of an organic diol or triol compound with at least one organic monobasic acid, e.g. di(tridecyl)adipate, and the like can be used in the finish of the invention.

The term "smoke point" and the method of determining smoke point are well known to those skilled in the art. Typically, manufacturers of lubricants will provide smoke point data for any given lubricant.

The third essential component of the finish of the invention constitutes a base neutralized 12 carbon to 25 carbon fatty acid, such as sodium, potassium, or ammonium; oleate, stearate, isostearate, or the like, with potassium oleate being especially preferred. Base neutralization must be conducted prior to emulsification. Thus, the neutralized fatty acid can be mixed with the other oily components or the free acid can be mixed with the other components and the entire mixture subsequently neutralized with base. By neutralization, it is meant that the finish emulsion should have a pH in the range of from about 6 to about 8. Upon mixing and neutralizing the various components, the finish emulsion should be allowed to stand for several hours. The pH should then be measured again since pH changes due to interaction of various components are not uncommon.

The amount of neutralized fatty acid used will be between about 3 and about 10 weight percent. The primary function of the neutralized acid in the finish of the invention is to promote emulsification of the finish. Thus, it will be present in an amount sufficient to emulsify the ethylene oxide/propylene oxide copolymer and the alkyl chain based lubricant. In this regard, an important aspect of the invention is that the ionic in nature, neutralized fatty acid is used to emulsify the lubricant and copolymer. Non-ionic emulsifiers are believed to be particularly detrimental to friction elements containing polyurethane or other hydrophilic polymers. Thus, the invention is best practiced by including substantially no non-ionic emulsifier in the finish.

The particular amount of neutralized fatty acid used, within the range set forth above, will depend on the nature and amounts of both the lubricant and the ethylene oxide/propylene oxide copolymer. Thus, the presence of hydrophilic moieties in the lubricant and/or an increased amount of ethylene oxide in the copolymer will allow use of a lesser amount of neutralized fatty acid while the lack of hydrophilic groups in the lubricant and/or a small amount of ethylene oxide in the copolymer will dictate use of a larger amount of neutralized fatty acid.

The finish will advantageously also include one or more antioxidant compositions which will assist maintenance of clean heater plates by scavaging free radicals. The amount of an antioxidant used will depend upon the nature of the particular antioxidant. Thus, with some known antioxidants an amount of up to 3 weight percent may be needed. Preferred antioxidants are those which donate a neutral hydrogen atom, for example, the hindered phenols or the secondary aromatic amines. Such antioxidants are preferably used in an amount of less than about 1 weight percent and it is especially preferred that they be used in synergistic combination with a reducing antioxidant such as a phosphite or hypophosphite. When such a synergistic combination is used, an amount of about 0.25 weight percent each of hindered phenol or secondary aromatic amine and phosphite or hypophosphite will be sufficient. If desired, the finish can include minor amounts of other materials, e.g. viscosity adjusting agents, colubricants and the like so long as such do not materially affect the basic nature and characteristics of the finish of the invention. In the latter regard, low molecular weight materials and non-ionic emulsifiers are to be avoided. The finish will also advantageously include trace amounts of antibacterial and antifungal compositions as will be known to those skilled in the art.

The oily finish will advantageously have a viscosity of from about 60 to about 130 centistokes at 45° C. A viscosity of from about 80 to about 100 centistokes at 45° C. is preferred for use with 200-400 denier partially oriented polyester while a lower viscosity is preferred with lower denier polyester yarn and a higher viscosity is preferred for higher denier polyester yarn.

The finish set forth above is applied to polyester yarn as an aqueous emulsion. The emulsion should be formulated so that the oil or organic phase constitutes between about 5 to about 15 weight percent, preferably between about 6 to about 8 weight percent of the emulsion. As known to those skilled in the art, oil content of the emulsion can be varied to accomplish various objectives, including the degree of finish pickup, lubricity, etc.

The finish can be applied to the yarn in any convenient manner, e.g. spraying, dipping, kiss roll contact or by using any of the various applicators known to those skilled in the art. Preferably, the emulsion is applied as a spin finish by means of a metered applicator located at the yarn conversion point, just after the quench zone, to the polyester partially oriented yarn during the spinning thereof. The finish is applied in an amount sufficient to provide between about 0.1 and about 1 percent by weight, preferably between about 0.3 and about 0.5 percent by weight, oil on yarn.

The following examples serve to illustrate the best mode contemplated for carrying out the invention.

EXAMPLE I

The following materials were mixed together in the proportions indicated:

| Percent | Composition |
|---|---|
| 25.0% | tetraethylene glycol di(mixed ester of decanoic and octonoic acids) (tetraethylene glycol dipelargonate) |
| 50.0% | 10%/90%, ethylene oxide/propylene oxide block copolymer, mol. wt. 2750 |
| 20.0% | 50%/50%, ethylene oxide/propylene oxide block copolymer, mol. wt. 1900. |
| 5.0% | oleic acid |
| 0.25 (on weight of oil) | trisnonyl phenol phosphite |
| 0.25% (on weight of oil) | hindered phenolic antioxidant |

Upon mixing of the above components, 5 wt. percent (on weight of oil) of a 10% aqueous solution of potassium hydroxide was added to neutralize the oleic acid. Viscosity of the oily finish was 88 cts. at 45° C. The finish was blended with sufficient water to provide an aqueous emulsion wherein the oil base constituted about 6 weight percent. To the emulsion was added a biocide, namely, 6-acetoxy-2, 4-dimethyl-meta-dioxane (commercially available as GIV-GARD DXN) in an amount of about 0.1 wt. percent based on emulsion weight. The emulsion was allowed to stand for twelve hours whereupon the pH had dropped from about 8.0 to about 6.2 due to hydrolysis of biocide. The emulsion was applied to partially oriented polyester yarn as a spin finish by means of a metered applicator located at the yarn convergence point, just after the quench zone to provide about 0.4 weight percent, oil on yarn. The polyester yarn bearing the finish was then textured in a commercial high speed urethane disc texturing operation. After sixteen weeks without cleaning of the texturing apparatus, there was no deposit on heater plates. Further, dye uptake uniformity and other quality aspects of the textured yarn were excellent. Filament breakage during texturing was minimal.

EXAMPLE II

A finish was prepared identically to the finish of Example I except that only 48.5% of the 10/90 EO/PO 2750 mol. wt. block copolymer was used and 1.5% of an ultrahigh molecular weight (9000–12000) 75%/25%, EO/PO random copolymer was added to the mixture. The emulsion was prepared as before and applied during spinning to partially oriented polyester yarn as in Example I as an about 8% emulsion to provide about 0.35% oil on fiber. It was found that the finish pickup was slightly improved. The yarn was textured in a laboratory high speed urethane disc texturing operation for ten days with no heater deposit observed and an acceptably low level of broken filaments.

EXAMPLE III

The following oily finish components were mixed together:

| Percent | Composition |
|---|---|
| 35.0% | triglycerol pentapelargonate |
| 50.0% | 10%/90%, ethylene oxide/propylene oxide block copolymer mol. wt. 2750 |
| 10% | 10%/90%, ethylene oxide/propylene oxide block copolymer, mol. wt. 1100 |
| 5% | oleic acid |

The above ingredients were mixed together and 5 wt. percent (o.w.o.) of a 10% solution potassium hydroxide was added to neutralize the oleic acid. The oily mixture was mixed with sufficient water to form about 8% oil in water emulsion and biocide as in Example I was added. The emulsion was allowed to stand for twelve hours and the pH had dropped from about 8.0 to 6.2. The emulsion was applied to partially oriented polyester yarn during spinning, as in Example I to provide about 0.35% oil on yarn. The yarn thus prepared was textured in a commercial high speed urethane disc draw texturing operation for eight weeks. There were substantially no deposits on the heater plate, the level of broken filaments was at a very low, commercially acceptable level and dye uptake variations in the resultant yarn were negligible.

EXAMPLE IV

The following oily components were added together:

| Percent | Composition |
|---|---|
| 15% | tetraethylene glycol di(mixed ester of decanoic and octonoic acid) |
| 10% | triglycerol pentapelargonate |
| 30% | 20%/80%, ethylene oxide/propylene oxide block copolymer, mol. wt. 2500 |
| 20% | 50%/50%, ethylene oxide/propylene oxide block copolymer, mol. wt. 1900 |
| 20% | 30%/70%, ethylene oxide/propylene oxide block copolymer, mol. wt. 1850 |
| 5% | oleic acid |
| 0.25% (on weight of oil) | trisnonyl phenol phosphite |
| 0.25% (on weight of oil) | hindered phenolic antioxidant |

The oleic acid was neutralized with aqueous potassium hydroxide as in Example I. The viscosity of the oil was 96 cts. at 45° C. Sufficient water was added to the oily mixture to form an about 8% aqueous emulsion and biocide was added as in Example I. After standing for twelve hours, the pH of the emulsion had dropped from 8.0 to 6.2. The emulsion was applied during spinning, as in Example I, to partially oriented polyester yarn to provide a finish level of about 0.35% by weight, oil on yarn. The resultant yarn was textured on a laboratory scale, high speed urethane disc draw texturing operation for ten days. No heater plate deposits were observed. The broken filament level was excellent.

EXAMPLE V

This Example illustrates the need for varying the amount of neutralized fatty acid, increasing ethylene oxide content in the copolymer and/or varying the amount or hydrophobic/hydrophilic nature of lubricant to achieve formulation of an emulsifiable finish. U.S. Pat. No. 4,134,882 to Frankfort et al discloses a partially oriented polyester yarn finish consisting of:

27 parts ditridecyl adipate
12.3 parts polyoxyethylene (30)sorbitol tetrastearate
4.9 parts polyoxyethylene(20)sorbitan tristerate
5.0 parts isostearic acid
1.6 parts potassium hydroxide (45%)
50 parts of a block copolymer of ethylene oxide and propylene oxide (1:10 mole ratio) having a number average molecular weight of 1100
0.25 part tris(nonylphenyl)phosphite
0.25 part 4,4'-butylidene bis(6-t-metacresol)
0.3 part of a random copolymer of ethylene oxide and propylene oxide having a viscosity of 9150 SUS at 100° F., Those skilled in the art will recognize that the polyoxyethylene sorbitol tristearate and tetrastearate, above, are non-ionic emulsifiers. In accordance with the principles of this invention, it is believed that such amounts of such materials would adversely affect urethane texturing discs. In order to determine whether such finish would be emulsifiable without the non-ionic emulsifiers, those materials were eliminated from the formulation above and a mixture was prepared from the other components in the same relative proportions (the phenolic and phosphite antioxidants were not included since the sole purpose of the experiment was to determine whether the resultant finish was emulsifiable). The finish consisted of:

32.8 parts ditridecyl adipate
6.1 parts isostearic acid
1.9 parts potassium hydroxide (45%)
60.75 parts of a block copolymer of ethylene oxide and propylene oxide (1:10 mole ratio) having a number average molecular weight of 1100
0.4 part of a random copolymer of ethylene oxide and propylene oxide having a viscosity of 9150 SUS at 100° F.

Following admixture of the above components, an attempt was made to emulsify the oily material with water. Emulsification was not achieved. Despite vigorous agitation of the mixture, the oily material simply formed a separate layer on top of the aqueous layer. In an attempt to achieve emulsification, the amount of isostearic acid was increased to 10% by weight of the mixture, the potassium hydroxide was proportionally increased and the other materials, in the same relative proportions to each other constituted the remaining 90 wt. percent of the mixture (excluding potassium hydroxide weight). The resultant mixture was agitated vigorously. Again, formation of a stable emulsion was not achieved.

One could readily modify the above mixture to provide an emulsifiable finish by following the teachings of this invention. This would be achieved by one or more of the following: increasing ethylene oxide content of the copolymer; increasing the proportional amount of copolymer; decreasing the proportional amount of lubricant; or substituting a more hydrophilic lubricant for part or all of the above lubricant.

The invention has been described in considerable detail with specific reference to various preferred embodiments. But, variations and modifications can be made without departing from the spirit and scope of the invention as described in the foregoing specification and defined in the appended claims.

What is claimed is:

1. A finish for partially oriented polyester yarn, said finish being an emulsifiable mixture consisting essentially of;

(a) from about 50 to about 90 weight percent of one or more ethylene oxide/propylene oxide copolymers having a molecular weight in excess of about 1000 and having an ethylene oxide content such that the ethylene oxide in the copolymer constitutes less than about 25 weight percent of the finish;
(b) from about 10 to about 35 weight percent of one or more alkyl chain based lubricants, a major amount of which has a smoke point within the range of from about 155° C. to about 200° C.; and
(c) a base neutralized fatty acid in an amount in the range of from about 3 to about 10 weight percent, and sufficient to emulsify the ethylene oxide/propylene oxide copolymer and the alkyl chain based lubricant.

2. The partially oriented polyester yarn finish defined in claim 1 further including one or more antioxidants in an amount of up to about 3 weight percent.

3. The partially oriented polyester yarn finish defined in claim 2 wherein said antioxidants include a hindered phenol or a secondary aromatic amine in combination with a phosphite or hypophosphite composition.

4. The partially oriented polyester yarn finish defined in claim 3 wherein said antioxidant compositions are present in an amount of less than about 1.0 weight percent of the finish.

5. The partially oriented polyester yarn finish defined in claim 1 wherein at least about 90 weight percent of said alkyl chain based lubricant has a smoke point within the range of from about 155° C. to about 200° C.

6. The partially oriented polyester yarn finish defined in claim 1 wherein the major proportion of said alkyl chain based lubricant has a smoke point within the range of from about 170° C. to about 180° C.

7. The partially oriented polyester yarn finish defined in claim 6 wherein at least 90 weight percent of said alkyl chain based lubricant has a smoke point within the range of from about 170° C. to about 180° C.

8. The partially oriented polyester yarn finish defined in claim 7 wherein at least 95 weight percent of said alkyl chain based lubricant has a smoke point in the range of from about 170° C to about 180° C.

9. The partially oriented polyester yarn finish defined in claim 1 wherein said ethylene oxide/propylene oxide copolymer constitutes from about 60 to about 80 weight percent of the finish.

10. The partially oriented polyester yarn finish defined in claim 1 wherein said base neutralized fatty acid is derived from a fatty acid having from 12 to 25 carbon atoms.

11. The partially oriented polyester yarn finish defined in claim 10 wherein said base neutralized fatty acid comprises potassium oleate.

12. The partially oriented polyester yarn finish defined in claim 1 wherein said finish has a viscosity of from about 60 to about 130 centistokes at about 45° C.

13. The partially oriented polyester yarn finish defined in claim 12 wherein said finish has a viscosity of from about 80 to about 100 centistokes at 45° C.

14. A partially oriented polyester yarn bearing a finish, said finish being an emulsifiable mixture consisting essentially of;

(a) from about 50 to about 90 weight percent of one or more ethylene oxide/propylene oxide copolymers having a molecular weight in excess of about 1000 and having an ethylene oxide content such that the ethylene oxide in the copolymer constitutes less than about 25 weight percent of the finish;

(b) from about 10 to about 35 weight percent of one or more alkyl chain based lubricants, a major amount of which has a smoke point within the range of from about 155° C. to about 200° C; and (c) a base neutralized fatty acid in an amount in the range of from about 3 to about 10 weight percent, and sufficient to emulsify the ethylene oxide/propylene oxide copolymer and the alkyl chain based lubricant.

15. The partially oriented polyester yarn defined in claim 14 wherein said finish additionally comprises one or more antioxidants in an amount of up to about 3.0 weight percent of the finish.

16. The partially oriented polyester yarn defined in claim 15 wherein said antioxidant composition comprises a hindered phenol or a secondary aromatic amine together with a phosphite or a hypophosphite.

17. The partially oriented polyester yarn defined in claim 14 wherein at least 90 weight percent of said alkyl chain based lubricant has a smoke point within the range of from about 155° C. to about 200° C.

18. The partially oriented polyester yarn defined in claim 17 wherein a major amount of said alkyl chain based lubricant has a smoke point within the range of from about 170° to 180° C.

19. The partially oriented polyester yarn defined in claim 18 wherein at least about 90 weight percent of said alkyl chain based lubricant has a smoke point within the range of from about 170° C. to about 180° C.

20. The partially oriented polyester yarn defined in claim 14 wherein said base neutralized fatty acid comprises potassium oleate.

21. The partially oriented polyester yarn defined in claim 14 wherein said ethylene oxide/propylene oxide copolymer constitutes from about 60 to about 80 weight percent of said finish.

* * * * *